US008726996B2

(12) United States Patent
Busaidy et al.

(10) Patent No.: US 8,726,996 B2
(45) Date of Patent: May 20, 2014

(54) DEVICE FOR THE FOCUS AND CONTROL OF DYNAMIC UNDERBALANCE OR DYNAMIC OVERBALANCE IN A WELLBORE

(75) Inventors: Adil Mahallab Al Busaidy, Seeb (OM); Karim Al Sayed, La Defence Cedex (FR); Fokko H. C. Doornbosch, Oegstgeest (NL); Carlos E. Baumann, Austin, TX (US); Lawrence A. Behrmann, Houston, TX (US); Harvey Williams, Houston, TX (US); Andrew J. Martin, Barton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 703 days.

(21) Appl. No.: 12/790,299

(22) Filed: May 28, 2010

(65) Prior Publication Data

US 2011/0132608 A1 Jun. 9, 2011

Related U.S. Application Data

(60) Provisional application No. 61/183,102, filed on Jun. 2, 2009.

(51) Int. Cl.

| | |
|---|---|
| ***E21B 43/11*** | (2006.01) |
| ***E21B 43/00*** | (2006.01) |
| ***E21B 43/116*** | (2006.01) |
| ***E21B 29/02*** | (2006.01) |
| ***E21B 33/12*** | (2006.01) |

(52) U.S. Cl.
USPC ..... 166/297; 166/63; 166/191; 175/4.52; 175/4.54

(58) Field of Classification Search
USPC ..... 166/297, 63, 55, 55.2, 191; 175/4.52, 175/4.54
See application file for complete search history.

(56) References Cited

U.S. PATENT DOCUMENTS 2,884,861 A 5/1959 Vincent et al.
4,082,298 A 4/1978 Sanford (Continued)

OTHER PUBLICATIONS

International Search Report & Written Opinion; International application No. PCT/US2010/036803; Jul. 30, 2010.

*Primary Examiner* — Nicole Coy
*Assistant Examiner* — Michael Wills, III
(74) *Attorney, Agent, or Firm* — Jeffery R. Peterson; Brandon S. Clark

(57) ABSTRACT

A downhole tool assembly for use in a wellbore includes a tubular body carrying an explosive which is selectively detonated to create a dynamic underbalance or overbalance effect in the wellbore. The tubular body has opposite ends provided with plug assemblies including plug elements movable between a normally collapsed state and an actuable expanded state. The plug elements are adapted to be actuated to the expanded state between the tubular body and an outer extent of the wellbore before the creation of the dynamic underbalance or overbalance effect to isolate a discrete segment of the wellbore to which the dynamic underbalance or overbalance effect is confined.

17 Claims, 5 Drawing Sheets

(56) References Cited

U.S. PATENT DOCUMENTS

| | | | | |
|---|---|---|---|---|
| 5,390,737 | A | 2/1995 | Jacobi et al. | |
| 5,704,426 | A | 1/1998 | Rytlewski et al. | |
| 6,874,579 | B2 * | 4/2005 | Johnson et al. | 166/298 |
| 6,966,377 | B2 * | 11/2005 | Johnson et al. | 166/297 |
| 7,284,612 | B2 | 10/2007 | Ratanasirigulchai et al. | |
| 7,533,722 | B2 | 5/2009 | George et al. | |
| 7,571,768 | B2 | 8/2009 | Cuthill | |
| 2006/0185839 | A1 * | 8/2006 | Tiernan | 166/63 |
| 2006/0249045 | A1 | 11/2006 | Goodman et al. | |
| 2008/0271894 | A1 * | 11/2008 | Hill et al. | 166/308.1 |
| 2009/0223714 | A1 * | 9/2009 | Hill et al. | 175/2 |

* cited by examiner

DEVICE FOR THE FOCUS AND CONTROL OF DYNAMIC UNDERBALANCE OR DYNAMIC OVERBALANCE IN A WELLBORE

RELATED APPLICATIONS

This application claims the benefit under 35 U.S.C. §119 (e) to U.S. Non-/Provisional Patent Application Ser. No. 61/183,102, entitled, "Device for Focus and Control of Dynamic Under Balance and Dynamic Over Balance in a Borehole," filed on Jun. 2, 2009. This application is hereby incorporated by reference in its entirety.

FIELD

The present disclosure generally relates to improving communication of formation fluids within a wellbore using dynamic underbalance or dynamic overbalance to effectively manipulate pressure conditions within a wellbore after perforation tunnels have been previously formed in the surrounding formation of a well.

BACKGROUND

To complete a well, one or more formation zones adjacent a wellbore are perforated to allow fluid from the formation zones to flow into the well for production to the surface or to allow injection fluids to be applied into the formation zones. A perforating gun string may be lowered into the wells and the guns fired to create openings in a casing and to extend perforation tunnels into the surrounding formation.

The explosive nature of the formation of perforation tunnels shatters sand grains of the formation. A layer of "shock damaged region" having a permeability lower than that of the virgin formation matrix may be formed around each perforation tunnel. The process may also generate a tunnel full of rock debris mixed in with the perforator charge debris. The extent of the damage, and the amount of loose debris in the tunnel, may be dictated by a variety of factors including formation properties, explosive charge properties, pressure conditions, fluid properties and so forth. The shock damaged region and loose debris in the perforation tunnels may impair the productivity of production wells or the injectivity of injector wells.

To address these issues, pressure in a wellbore interval is manipulated in relation to the reservoir or surrounding formation pore pressure to achieve removal of debris from perforation tunnels. The pressure manipulation includes creating a transient underbalance condition (the wellbore pressure being lower than a formation pore pressure) prior to detonation of a detonation cord or shaped charges of limited energy. Pressure manipulation also includes creating an overbalance pressure condition (when the wellbore pressure is higher than the formation pore pressure) prior to detonation or explosion of shaped charges of a perforating gun or a propellant. Creation of an underbalance condition can be accomplished in a number of different ways, such as by use of a low pressure chamber that is opened to create the transient underbalance condition, the use of empty space in a perforating gun or tube to draw pressure into the gun right after firing of shaped charges, and other techniques. The underbalanced condition results in a suction force that will extract debris out of the perforation tunnels and fluid from the wellbore into the tube enabling the well to flow more effectively or more efficient injection of fluids into the surrounding formation. Creation of an overbalance condition can be accomplished by use of a propellant (which when detonated causes high pressure gas buildup), a pressurized chamber, or other techniques. The burning of the propellant can cause pressure to increase to a sufficiently high level to fracture the formation. The fracturing allows for better communication of reservoir fluids from the formation into the wellbore or the injection of fluids into the surrounding formation.

The manipulation of wellbore pressure conditions causes at least one of the following to be performed: (1) enhance transport of debris (such as sand, rock particles, etc.) from perforation tunnels; (2) achieve near-wellbore stimulation; and (3) perform fracturing of surrounding formation.

During the manipulation of pressure, one or more packers or plugs are known to be positioned between the inside of the wellbore and the outside of the perforating gun or tube to isolate the interval over which the detonation or explosion takes place to achieve a quicker and amplified response for the underbalance or overbalance effect.

It remains desirable to provide a device for confining the effects of a dynamic underbalance or dynamic overbalance in a defined region of the wellbore to enable removal of debris from the perforation tunnels and/or stimulation within the well.

SUMMARY

The present application discloses a downhole tool assembly defining a transient plug arrangement which improves communication of formation fluids in the wellbore. In one example, a downhole tool assembly for use in a wellbore includes a tubular body carrying an explosive which is selectively detonated to create a dynamic underbalance or overbalance effect in the wellbore. The tubular body has opposite ends provided with plug assemblies including plug elements movable between a normally collapsed state and an actuable expanded state. The plug elements are adapted to be actuated to the expanded state between the tubular body and an outer extent of the wellbore before the creation of the dynamic underbalance or overbalance effect to isolate a discrete segment of the wellbore to which the dynamic underbalance or overbalance effect is confined.

In the particular example disclosed, the plug assemblies are responsive to detonation of the explosive such that the plug elements are actuated to the expanded state between the tubular body and an outer extent of the wellbore to isolate the discrete segment of the wellbore to which purging of the debris filled perforation tunnels or stimulation of wellbore is concentrated. In an alternative method, the plug assemblies could be actuated by an electrical, hydraulic or mechanical command.

The present disclosure further contemplates an exemplary method for forming and controlling a dynamic underbalance or dynamic overbalance effect on a wellbore wherein the method includes the steps of (1) lowering a downhole tool assembly into a wellbore adjacent a formation zone of perforation tunnels previously formed in a formation surrounding the wellbore, the tool assembly carrying an explosive and having plug assemblies including expandable and collapsible plug elements provided at opposite ends thereof wherein the plug elements are normally in a collapsed state spaced from an outer extent of the wellbore and are actuable to an expanded state; (2) activating the plug elements to the expanded state such that the plug elements extend between the downhole tool assembly and the outer extent of the wellbore to isolate a discrete segment of the wellbore from a remainder of the wellbore; (3) detonating the explosive in the downhole tool assembly to create a dynamic underbalance or overbalance effect confined to the discrete segment of the wellbore for purging the perforation tunnels or stimulating the wellbores; and (4) deactivating the plug elements to the collapsed state upon termination of the dynamic underbalance or overbalance effect.

BRIEF DESCRIPTION OF THE DRAWINGS

The best mode is described herein below with reference to the following drawing figures.

DETAILED DESCRIPTION

In the following description, certain terms have been used for brevity, clearness and understanding. No unnecessary limitations are to be implied therefrom beyond the requirement of prior art because such terms are used for descriptive purposes and are intended to be broadly construed. The different configurations and methods described herein may be used alone or in combination with other configurations, systems and methods. It is to be expected that various equivalents, alternatives and modifications are possible within the scope of the appended claims.

Figure 1:
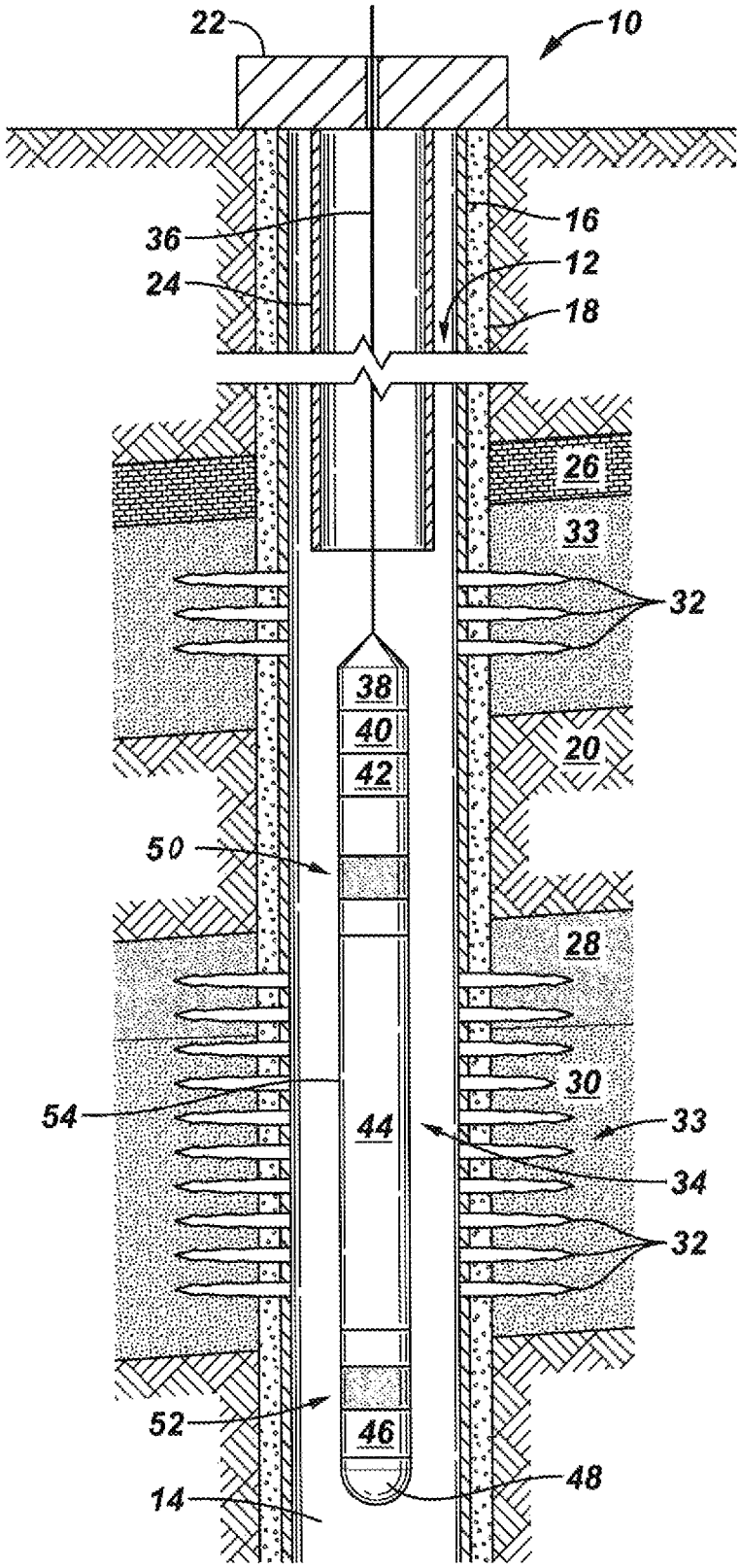
FIG. 1 is a sectional view of a well formation having a wellbore provided with a downhole tool assembly according to the present disclosure.

Referring now to the drawings, FIG. 1 illustrates a typical well installation 10 including a wellbore 12 normally containing borehole fluid 14. As is well known, the wellbore 12 has a surrounding casing 16 and cement 18 disposed between the casing 16 and the surrounding surface formation 20. A wellhead 22 is positioned at the top of the surface formation 20, and is provided with an open bottom tubing 24 that extends downwardly into an upper portion of the wellbore 12. In the well installation 10 illustrated, the surface formation 20 includes an area of caprock 26, a damaged formation 28 and an undamaged formation 30, all of which surround cement 18. Perforation tunnels 32 extend through the casing 16 and cement 18 into the damage formation 28 at one or more desired formation zones 33.

The perforation tunnels 32 are previously formed using a perforating gun string to allow fluid flow from the formation zones 33 to flow into the well for production to the surface, or to allow stimulating injection fluids to be applied to the formation zones. The explosive nature of the formation of the perforation tunnels 32 shatters the sand grains in the damaged formation 28 and typically generates tunnels 32 full of rock debris mixed in with perforator charge debris. Such debris is known to impair the productivity of production wells and negatively impact upon the flow of formation fluids in the well. The present disclosure sets forth a device provided with a transient plug arrangement which is used to clean the debris from the plug perforation tunnels 32 or otherwise stimulate the surface formation 20 by focusing and controlling a dynamic underbalance or dynamic overbalance condition in a desired formation zone 33 so as to improve fluid communication in this zone 33 of the well.

In accordance with the present disclosure, a downhole tool assembly 34 is lowered into the wellbore 12 in a zone of previously formed perforation tunnels 32. The tool assembly is suspended in the wellbore 12 by a carrier structure such as by a cable 36 that extends through the wellhead 22. The lower end of cable 36 is secured to a head 38 which, in turn, is connected to a casing collar locator 40 and a firing head 42. A downhole tool 44 in the form of an elongated hollow gun or tube has an upper end that is connected to the firing head 42, and a lower head attached to a connector 46 with a threaded end plug 48. The downhole tool assembly 34 includes an upper plug assembly 50 positioned above and in communication with the downhole tool 44, and a lower plug assembly 52 inverted with respect to, and similar in construction to plug assembly 50 and positioned below and in communication with the downhole tool assembly 44. Because of the similarity and construction of the upper plug assembly 50 and the lower plug assembly 52, only the description of the lower plug assembly 52 is set forth hereafter.

Figure 2:
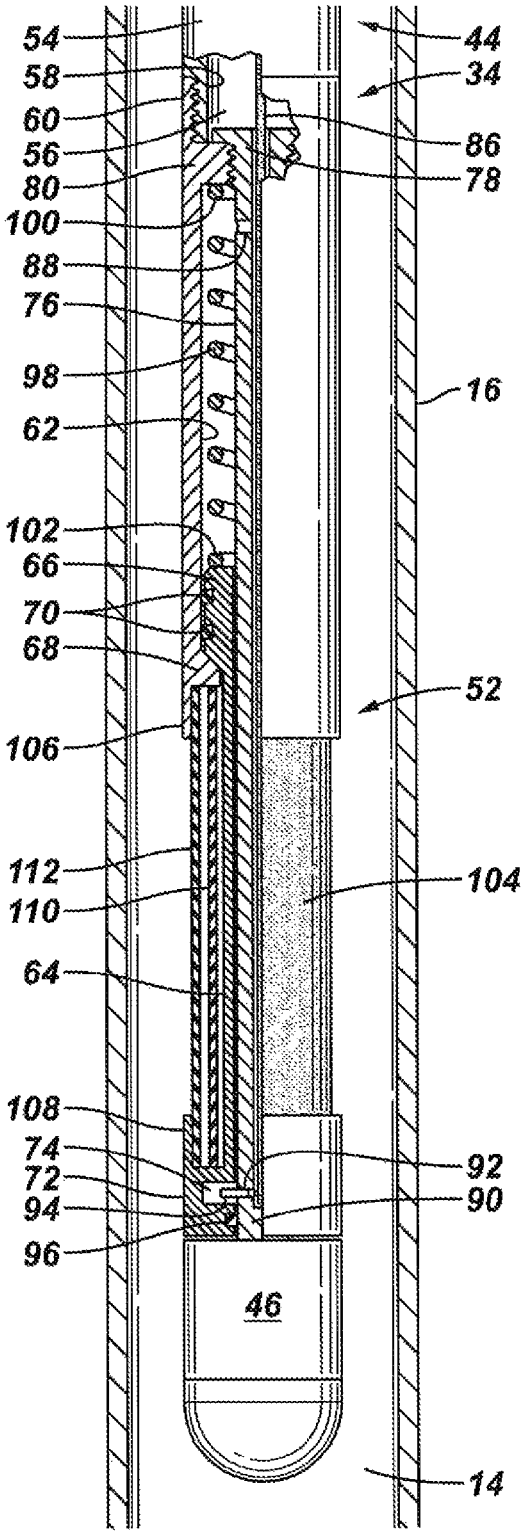
FIG. 2 is an enlarged fragmentary sectional view of a lower portion of FIG. 1 in an unfired condition with certain portions of the structure surrounding the wellbore being omitted for simplicity.
Figure 3:
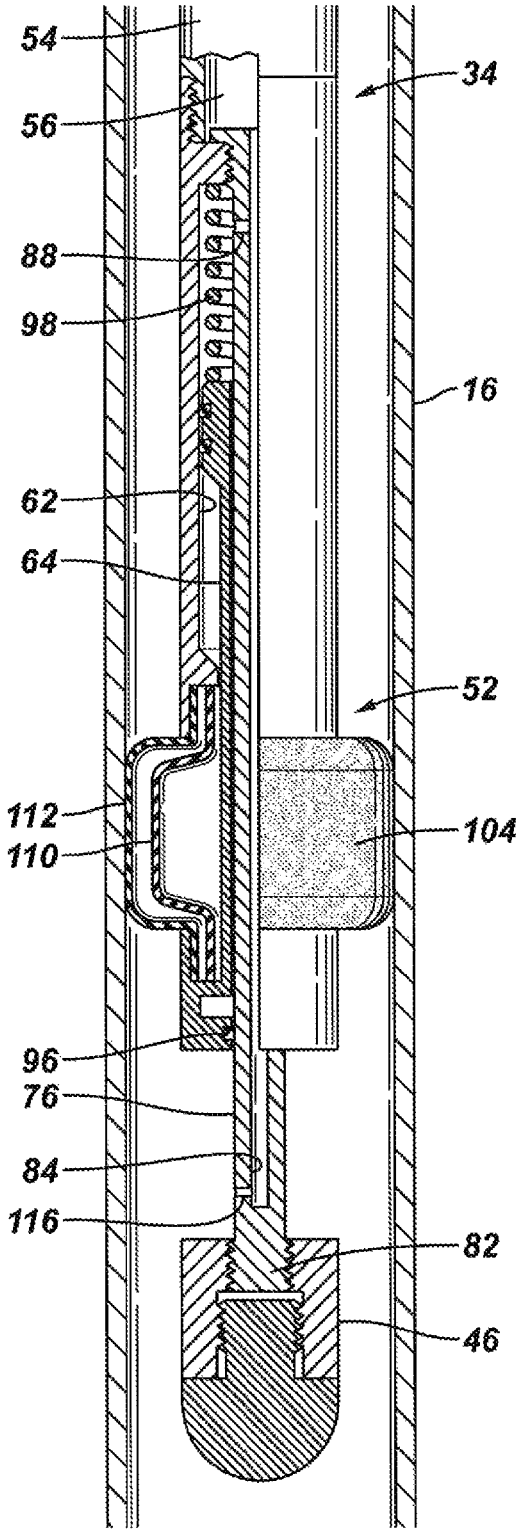
FIG. 3 is an enlarged fragmentary sectional view similar to FIG. 2 showing the downhole tool assembly during a fired condition.

FIG. 2 shows the downhole tool assembly 34 in an installed or unfired condition, while FIG. 3 illustrates the downhole tool assembly 34 during a fired condition.

FIGS. 1-6 depict the downhole tool assembly 34 as used to focus and control the effects of dynamic underbalance in a chosen area of the wellbore 12. However, as will be understood hereafter, the downhole tool assembly 34 may also be employed to isolate the effects of dynamic overbalance, if desired.

Referring now to FIGS. 1-3, the downhole tool 44 has an elongated tubular body 54 which is generally cylindrical in cross section. It can be appreciated from FIG. 1, that downhole tool 44 as well as head 38, casing collar locator 40, firing head 42, the upper and lower plug assemblies 50, 52 and the connector 46 all have substantially similar cylindrical shape and outer diameters which will permit the insertion and extraction of assembly 34 relative to wellbore 12. The tubular body 54, when positioned in the downhole tool assembly 34, defines a sealed internal underbalance chamber 56 (FIGS. 2 and 3) which typically contains only air at atmospheric pressure such as that set at the well surface for insertion into the wellbore 12. Air at atmospheric pressure provides an internal chamber pressure which is significantly less than the wellbore pressure encountered at a formation zone 33 or the formation pore pressure.

As seen in FIG. 2, the tubular body 54 has a trunk 58 which is threadedly connected to an upper end 60 of elongated hollow cylinder 62 that extends from the body 54. An elongated hollow piston 64 is disposed for sliding movement back and forth inside the cylinder 62. The piston 64 has an enlarged upper end 66 that normally is positioned against a lower end 68 of the cylinder 62 when the assembly 34 is in the unfired condition in the wellbore 12. A pair of annular O-rings or seals 70 is provided between the inner surface of cylinder 62 and the outer surface of the piston upper end 66. A lower end 72 of the piston 64 is formed with a central recess 74, and is normally disposed upon the top of connector 46 when the assembly 34 is in the unfired condition.

The piston 64 slides back and forth upon an elongated hollow mandrel 76 that has a top end 78 threadably secured to a neck portion 80 of a cylinder 62 such that the mandrel 76 extends through the center of the cylinder 62 and lies inwardly of the piston 64. As seen from FIG. 3, a lower end 82 of the mandrel 76 is threadably attached to the connector 46. The mandrel 76 is formed with a vertically extending passageway 84 (FIG. 3) which opens into tubular body 54, and is designed to hold a detonating or primer cord 86 that extends between the firing head 42 and the lower end 72 of piston 64 when assembly 34 is in the unfired condition. If a non-explosive device is required, the passageway 84 would contain electrical connections leading to an electrical release system.

An upper portion of mandrel 76 is constructed with a vent 88 that communicates with an interior of cylinder 62. A lower end 90 of the mandrel 76 is provided with an opening 92 for retaining a rupture element, electrical release or shear disk 94 that normally extends radially into the piston recess 74 when the assembly 34 is in the unfired condition. An annular O-ring or seal 96 is provided between the lower end 90 of mandrel 76 and the lower end 72 of piston 64. A coil spring 98 surrounds the mandrel 76 and lies inwardly of the inner surface of cylinder 62. The spring has a top end 100 engaged against the neck portion 80 of the cylinder 62, and a bottom end 102 engaged against the upper end 66 of piston 64.

The lower plug assembly 52 (as well as the upper plug assembly 50) typically includes a flexible, elastomeric production packer or plug element 104 which is expandable and collapsible. The plug element 104 is generally designed to be temperature, chemical and tear resistant as well as extremely elastic. As seen in FIG. 2, the plug element 104 surrounds the piston 64 and extends between the cylinder 62 and the piston 64. More particularly, a top end 106 of the plug element 104 is attached to a recessed portion at the lower end 68 of cylinder 62. A bottom end 108 of the plug element 104 is secured to a recessed portion at the lower end 72 of piston 64. In the example shown, the plug element 104 has an inner layer 110 and an outer layer 112.

As will be explained in greater detail below, the foregoing construction generally provides that each plug element 104 is movable between collapsed and expanded states or positions relative to the inside of casing 16 by virtue of sliding movement of piston 64 relative to the cylinder 62 and the mandrel 76.

Figure 4:
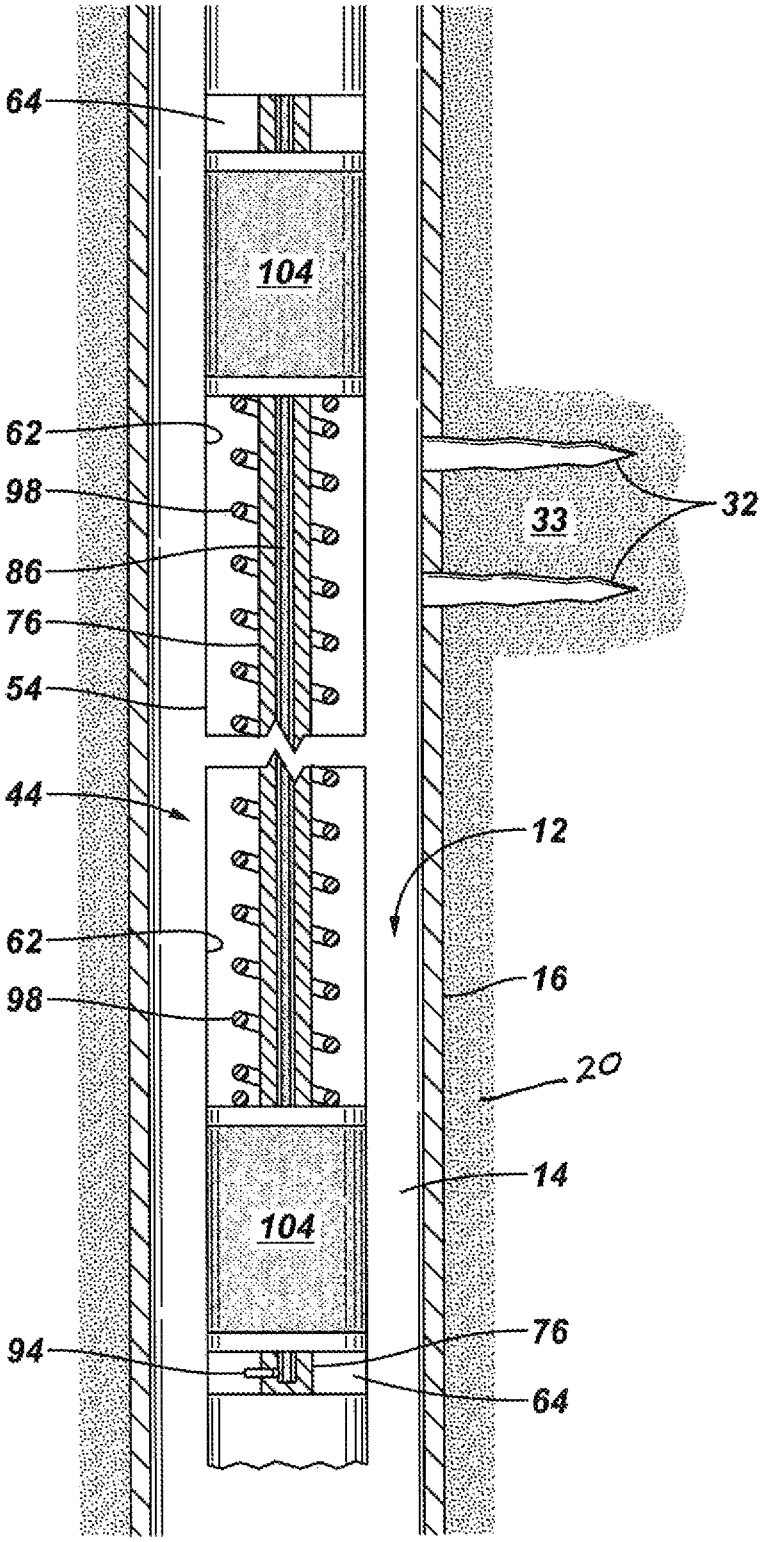
FIG. 4 is a representation of the downhole tool assembly of FIG. 1.

The operation of the downhole tool assembly 34 of the present disclosure will now be described, with initial reference to FIGS. 1 and 4 which show the tool 44 suspended in the wellbore 12 containing borehole fluid 14 and positioned adjacent a formation zone 33 having a series of previously formed perforation tunnels 32 filled with damage and debris. The tool 44 is in the installed or unfired condition as described above with internal chamber 56 (FIG. 1) of the tool 44 being at atmospheric pressure which is significantly lower than the pressure in the surrounding wellbore 12 and the pore pressure of surrounding formation 20. The lower pressure in internal chamber 56 is in communication with the top of each piston 64 via the mandrel passageway 84 and the vent 88. Each piston 64 is prevented from slidably moving along its mandrel 76 towards the low pressure in chamber 56 by the engagement of the ruptured disk 94 in the mandrel 76 and, to some extent, by the spring 98 which is normally biased against the top of piston 64.

Figure 5:
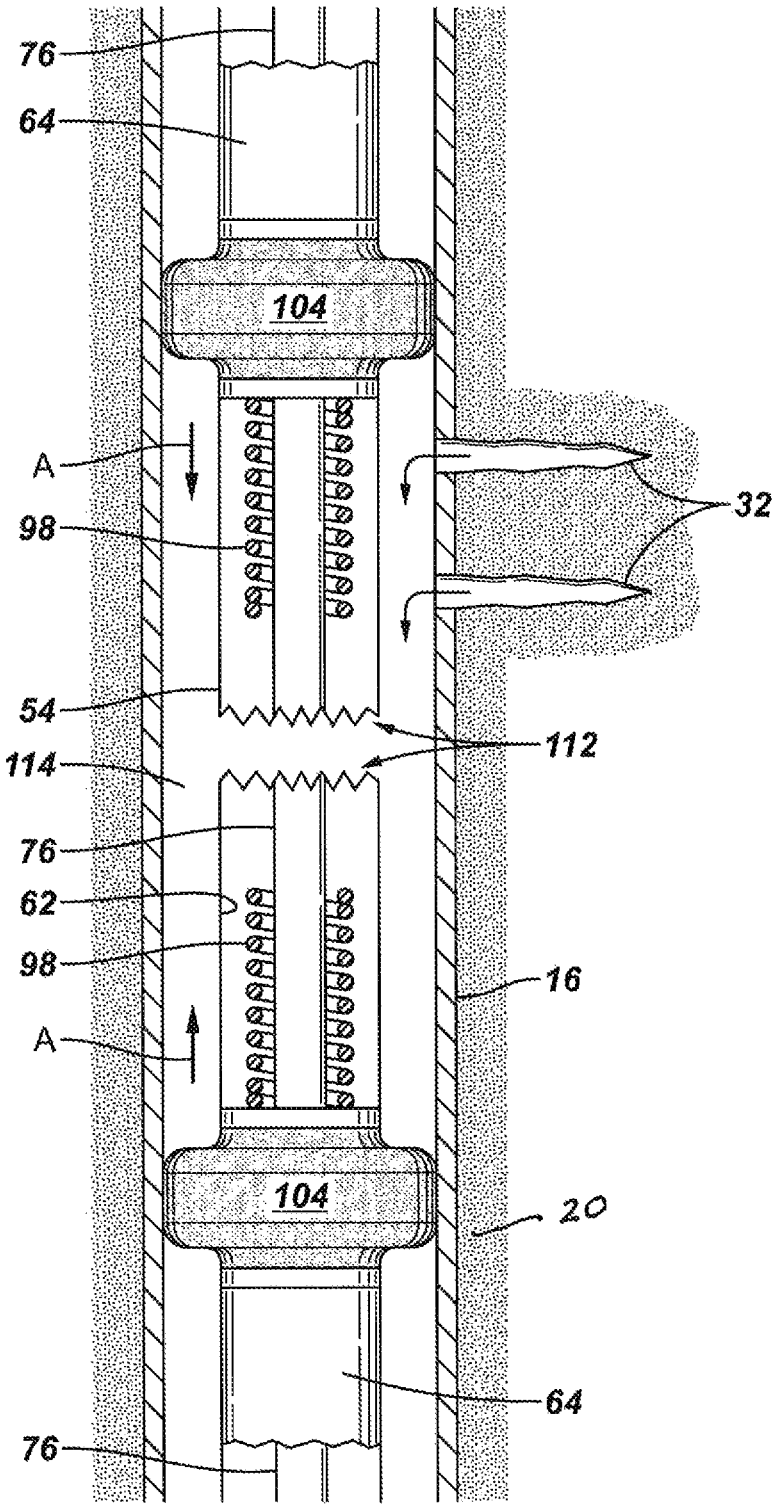
FIG. 5 is a representation of the downhole tool assembly of FIG. 3.

When it is desired to focus an underbalance event in a desired formation zone 33, a well operator actuates the firing head 42 and detonates the primer cord 86 causing an extremely rapid explosion along the entire length thereof. The firing of primer cord 86 causes rupturing 112 of the tubular body 54, as shown in FIG. 5, and also ruptures the shear disks 94 which frees the pistons 64 to slide along the mandrels 76. Rupturing the tubular body 54 creates a pressure differential between the higher pressure in wellbore 12 and the lower pressure in the internal chamber 56. This causes the pistons 64 to move quickly along mandrels 76 towards each other in the direction of arrows A shown in FIG. 5 against the relatively weak force of springs 98 which are compressed. At the same time, flexible plug elements 104 are rapidly squeezed or compressed adjacent the ends 68 of the cylinders 62 (FIG. 3) so as to instantaneously deploy and expand the plug elements 104 into temporary plugging engagement with the inside of casing 16. The existing pressure forces maintain the pistons 64 and plug elements 104 in position.

Figure 6:
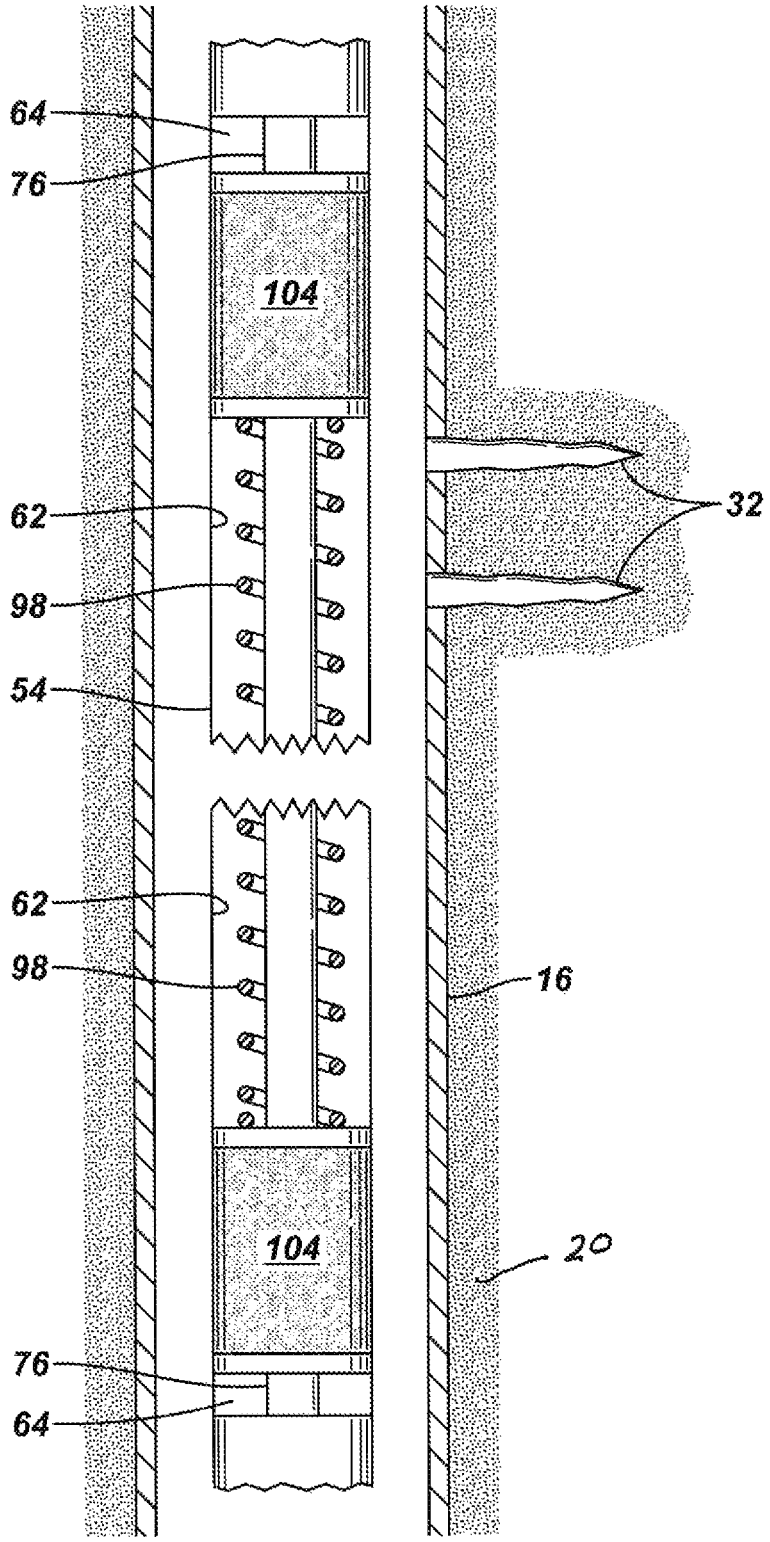
FIG. 6 is a further representation of the downhole tool assembly following a fired condition.

Upon instantaneous deployment of the plug elements 104, a dynamic underbalance effect created by the pressure differential is initiated resulting in a suction flow of the fluid from the wellbore 12 and debris from the perforation tunnels 32 only from the isolated wellbore zone 114 (FIG. 5) defined by and between the expanded plug elements 104. In the meantime, the low pressure sides of the pistons 64 are flooded with borehole fluid 14 which flows through the exposed ruptured openings 116 (FIG. 3) and the passageways 84 in mandrels 76 equalizing the pressure and allowing the plug elements 104 to turn to their original collapsed shape and dimensions. The equalized pressure also allows the compressed springs 98 to assist in returning the plug elements 104 to their original shape as shown in FIG. 6. Upon restoration of the plug elements 104 to their initial condition, the tool 44 filled with fluid and debris is extracted from wellbore 12 such that the cleaned material deposited in the tubular body 54 may be analyzed, if desired. Thereafter, the fractured tool 44 including the plug elements 104 may be disposed of.

It should be understood from the above exemplary embodiment that the downhole tool assembly 34 creates a transient mechanical plug arrangement that is utilized to focus and control the effect of dynamic underbalance in the wellbore zone 114 temporarily defined by the expanded plug elements 104. Such arrangement disrupts the movement and pressure effects of the borehole fluids outside the wellbore zone 114 towards the area of dynamic underbalance so as to maximize the effect of cleaning of debris from the perforation tunnels 32 in the zone 114. In addition, the transient plug arrangement confines the effect of the explosion occurring in the tubular body 54 to the defined wellbore zone 114.

While the exemplary embodiment set forth above is described for a dynamic underbalance effect, it should be appreciated that the present disclosure can also be used to focus and control the effects of dynamic overbalance, if desired. In such case, plug elements 104 would again be positioned above and below a dynamic overbalance chamber defined by tool 44, and tubes having low pressure chambers would be positioned above and below plug elements 104.

In the present disclosure, the plug elements 104 are self-deployed by the pressure differential created by the detonation before the transient pressure event (dynamic underbalance or dynamic overbalance) occurs. However, it should be realized that the plug deployment may be independent of the event that causes the underbalance or overbalance condition. That is, it is not essential that the plug deployment be triggered by the primer cord explosion. Plug deployment, as well as rupturing of the tubular body 54, could otherwise be actuated, such as, for example, by an electrical solenoid or other electromechanical or hydraulic device before the underbalance or overbalance effect takes place.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Various alternatives and embodiments are contemplated as being with in the scope of the following claims, particularly pointing out and distinctly claiming the subject matter regarded as the invention.

What is claimed is:

1. A downhole tool assembly for use in a wellbore comprising:

a tubular body carrying an explosive which is selectively detonated to create a dynamic underbalance or overbalance effect in the wellbore, the tubular body having opposite ends provided with plug assemblies including plug elements movable between a normally collapsed state and an actuable expanded state, wherein each plug assembly includes an elongated hollow cylinder connected to the tubular body and an elongated hollow mandrel is connected to and extends through and beneath the cylinder, wherein the plug elements are adapted to be actuated to the expanded state between the tubular body and an outer extent of the wellbore before the creation of the dynamic underbalance or overbalance effect to isolate a discrete segment of the wellbore to which the dynamic underbalance or overbalance effect is confined, wherein further the plug elements self-deploy to the expanded state upon detonation of the explosive or other activation of the plug elements, the tubular body having an internal chamber adapted to be exposed to the wellbore upon detonation of the explosive or other rupturing of the tubular body.

2. The downhole tool assembly of claim 1, wherein the mandrel has a passageway in communication with the internal chamber of the tubular body.

3. The downhole tool assembly of claim 2, wherein the mandrel has a vent that permits communication between the passageway and an interior portion of the cylinder.

4. The downhole tool assembly of claim 2, wherein the explosive is an elongated detonating cord that is positioned in the passageway of the mandrel.

5. The downhole tool assembly of claim 1, wherein an elongated piston is mounted for sliding movement relative to the mandrel and the cylinder.

6. The downhole tool assembly of claim 5, wherein a spring surrounds the mandrel and is disposed between the cylinder and the piston.

7. The downhole tool assembly of claim 5, wherein each plug element is a flexible, elastomeric element attached between the cylinder and the piston.

8. The downhole tool assembly of claim 5, wherein each plug element surrounds the mandrel and the piston.

9. The downhole tool assembly of claim 5, wherein a shear element is disposed between the mandrel and the piston.

10. The downhole tool assembly of claim 9, wherein the sliding movement of the piston relative to the mandrel and the cylinder is normally prevented by the shear element disposed between the mandrel and the piston.

11. The downhole tool assembly of claim 9, wherein sliding movement of the piston relative to the mandrel and the cylinder is permitted upon detonation of the explosive to rupture of the shear element.

12. The downhole tool assembly of claim 5, wherein each plug element is movable between the collapsed and expanded states by the sliding movement of the piston relative to the mandrel and the cylinder.

13. The downhole tool assembly of claim 5, wherein each plug element is selectively actuated to the expanded state by squeezing the plug element between the piston and the cylinder.

14. A downhole tool assembly for use in a wellbore having a series of perforation tunnels previously formed in a surrounding well formation and filled with debris, the downhole assembly comprising:

a tubular body positioned in the wellbore adjacent the previously formed perforation tunnels, the tubular body carrying an explosive which is selectively actuated to create a dynamic underbalance or overbalance effect in the wellbore, and having opposite ends provided with plug assemblies including plug elements movable between a normally collapsed state and an actuable expanded state, wherein the plug assemblies are responsive to detonation of the explosive such that the plug elements are actuated to the expanded state between the tubular body and an outer extent of the wellbore to isolate a discrete segment of the wellbore to which purging of the debris filled perforation tunnels or stimulation of the wellbore is confined.

15. The downhole tool assembly of claim 14, wherein each plug element is selectively actuated to the expanded state by squeezing the plug element between cooperating elements of the plug assemblies.

16. A method for focusing and containing a dynamic underbalance or dynamic overbalance effect in a wellbore, the method comprising the steps of:

lowering a downhole tool assembly into a wellbore adjacent a formation zone of perforation tunnels previously formed in a formation surrounding the wellbore, the tool assembly carrying an explosive and having plug assemblies including expandable and collapsible plug elements provided at opposite ends thereof, wherein the plug elements are normally in a collapsed state spaced from an outer extent of the wellbore and are actuable to an expanded state;

activating the plug elements to the expanded state such that the plug elements extend between the tool assembly and the outer extent of the wellbore to isolate a discrete segment of the wellbore from a remainder of the wellbore;

detonating the explosive in the downhole tool assembly to create a dynamic underbalance or overbalance effect confined to the discrete segment of the wellbore for purging the perforation tunnels or stimulating the wellbore, wherein the plug elements are activated in response to detonation of the explosive; and deactivating the plug elements to the collapsed state upon termination of the dynamic underbalance or overbalance effect.

17. The method of claim 16, wherein the plug elements are actuated to the expanded state by squeezing the plug elements between cooperating elements of the plug assemblies.

* * * * *